US008491103B2

(12) United States Patent
Kato et al.

(10) Patent No.: US 8,491,103 B2
(45) Date of Patent: Jul. 23, 2013

(54) INKJET HEAD

(75) Inventors: Masaki Kato, Tokyo (JP); Kiyoshi Yamaguchi, Kanagawa (JP); Mitsuru Shingyohuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/367,584

(22) Filed: Feb. 7, 2012

(65) Prior Publication Data

US 2012/0206540 A1 Aug. 16, 2012

(30) Foreign Application Priority Data

Feb. 10, 2011 (JP) ..... 2011-027673

(51) Int. Cl.
*B41J 2/045* (2006.01)
*B41J 2/14* (2006.01)

(52) U.S. Cl.
USPC ..... 347/68; 347/50; 347/70

(58) Field of Classification Search
USPC ..... 347/50, 68, 70
See application file for complete search history.

(56) References Cited

U.S. PATENT DOCUMENTS

| | | | | |
|---|---|---|---|---|
| 6,231,169 | B1 | 5/2001 | Yazaki et al. | |
| 6,840,601 | B2 | 1/2005 | Miyata | |
| 6,923,528 | B2 | 8/2005 | Shimada | |
| 7,524,038 | B2 | 4/2009 | Takahashi | |
| 2009/0085435 | A1* | 4/2009 | Sekiguchi | 347/68 |
| 2011/0169896 | A1* | 7/2011 | Miyazawa et al. | 347/68 |

FOREIGN PATENT DOCUMENTS

| | | |
|---|---|---|
| JP | 2004-1431 | 1/2004 |
| JP | 2004-82623 | 3/2004 |
| JP | 2005-144847 | 6/2005 |
| JP | 2006-239966 | 9/2006 |
| JP | 3468276 | 9/2006 |
| JP | 2007-118265 | 5/2007 |
| JP | 3994255 | 8/2007 |
| JP | 4218309 | 11/2008 |
| JP | 4340048 | 7/2009 |

* cited by examiner

*Primary Examiner* — Jannelle M Lebron
(74) *Attorney, Agent, or Firm* — Cooper & Dunham LLP

(57) ABSTRACT

Disclosed is an inkjet head including a channel substrate; a multi-interconnect structure formed on the channel substrate, including a vibration layer, plural piezoelectric elements each including a first electrode, a piezoelectric layer and a second electrode, and a common electrode interconnect electrically connected to the first electrode including a first common electrode interconnect and a second common electrode interconnect which has a thickness thicker than that of the first common electrode interconnect; and a support substrate bonded to the channel substrate through the multi-interconnect structure, the support substrate being provided with a first concave portion at a surface facing the channel substrate at an area corresponding to the second common electrode interconnect to accommodate the second common electrode interconnect.

13 Claims, 9 Drawing Sheets

INKJET HEAD

BACKGROUND OF THE INVENTION

1. Field of the Invention

The present invention relates to an inkjet head, and more specifically, to an inkjet head that discharges droplets from micro nozzles in accordance with a pressure change generated by applying electric power to a piezoelectric element provided at an individual ink chamber to form a pattern.

2. Description of the Related Art

For an inkjet head that forms a pattern by discharging micro droplets, plural types of products are provided where a pressure change is generated in an individual ink chamber. For example, there are a thermal inkjet type in which a heater is set in the individual ink chamber to vaporize liquid to cause a pressure change and a type using an actuator set in the individual ink chamber. For the type using an actuator, based on the type of actuators, a piezoelectric element type or an electrostatic type may be included.

For the type using an actuator, although it is capable to use ink of a wide variety of physical properties, there has been a problem in making high density individual ink chambers for downsizing a head. However, by using a so-called Micro Electro Mechanical Systems (MEMS) process, a technique to make high density individual ink chambers has been established. In this process, a unimorph type actuator is provided at each of the individual ink chambers by forming a stacked structure of a vibration layer, electrodes, a piezoelectric layer or the like using a semiconductor device manufacturing process such as a thin layer forming technique and patterning each of the piezoelectric elements or electrodes using a semiconductor device manufacturing process such as a photolithography to make high density individual ink chambers.

When forming electrodes or interconnects by the thin layer forming technique, as a layer of a metal or an alloy is formed by sputtering, Chemical Vapor Deposition (CVD), or the like it is difficult to form a thick layer. Concretely, it is difficult to form a layer whose thickness is more than or equal to 5 μm. Generally, it is necessary to have the thickness of the layer less than or equal to 1 μm in the light of a layer stress or manufacturing efficiency (process time) when the thin layer forming technique is used. Therefore, when the thin layer forming technique is used, in order to reduce an electric resistance of the electrodes or the interconnects, it is necessary to broaden the dimension of the electrode or the interconnects. As a result, the size of the head becomes larger and the number of chips obtained from a single wafer becomes smaller to costs to go up.

For an inkjet head, printing speed can be increased by increasing the density, in other words, increasing the number of nozzles provided for the inkjet head, so that the number of discharging dots for each scan can be increased. Therefore, it is necessary to increase the number of nozzles, in other words, the number of piezoelectric elements, provided per head. The nozzles or the piezoelectric elements are aligned in a predetermined direction in the head. When a large number of nozzles are provided per head, generally, a common electrode interconnect by which voltage is commonly applied to the entirety of the piezoelectric elements is formed to extend in the predetermined direction in which the piezoelectric elements or the nozzles are aligned and the voltage is applied from both sides of the common electrode interconnect. However, when the resistance of the common electrode interconnect is high, voltage drop occurs especially near the center. For nozzles near the center, since not enough voltage is applied to the corresponding piezoelectric elements, droplets cannot be properly discharged which deteriorates uniform discharging. When the common electrode interconnect is formed by the thin layer forming technique, the thickness of the common electrode interconnect becomes thinner as described above and the resistance value becomes higher so that the above voltage drop occurs remarkably. Therefore, there is a problem that the high density of nozzles obtained by the semiconductor device manufacturing process cannot be utilized because of the high resistance of the common electrode interconnect.

It is disclosed in Patent Document 1, a technique related to an inkjet head in which a common electrode interconnect is formed to extend in a direction in which individual ink chambers are aligned at one side of the individual ink chambers where individual electrode interconnects corresponding to the individual ink chambers are provided at other side of the individual ink chambers, the common electrode interconnect is further extended to the sides of the individual electrodes, and the common electrode interconnect is formed by metal having a low value of resistance to improve discharging uniformity. Further, according to Patent Document 1, concave portions are formed between the common electrode interconnect and the individual ink chambers to release the stress generated when piezoelectric elements are actuated.

It is disclosed in Patent Document 2, a technique related to an inkjet head in which an ink channel is formed to have the same height as that of an individual ink chamber and a piezoelectric layer is extended above the ink channel to strengthen the structure and prevent damage such as cracking or the like to a vibration layer formed on the ink channel.

It is disclosed in Patent Document 3, a technique related to an inkjet head in which a connecting interconnect layer electrically connected to a lower electrode (which is a common electrode) is formed to extend in a direction in which ink chambers are aligned to lower the resistance of the common electrode and to reduce variation in discharging.

It is disclosed in Patent Document 4, a technique related to an inkjet head in which a stacked electrode electrically connected to a lower electrode (which is a part of a common electrode) is formed at an outside area of individual ink chambers as the common electrode to lower the resistance of the common electrode and to reduce variation in discharging. Further, according to Patent Document 4, a stress releasing layer having a small thermal expansion coefficient (larger than that of a vibration layer and smaller than that of the stacked electrode) is provided at an end of the stacked electrode to prevent the removal of the stacked electrode by high temperature during manufacturing so that the damage to the vibration layer can also be prevented.

Patent Documents

[Patent Document 1] Japanese Patent No. 3,994,255
[Patent Document 2] Japanese Patent No. 4,340,048
[Patent Document 3] Japanese Laid-open Patent Publication No. 2004-001431
[Patent Document 4] Japanese Laid-open Patent Publication No. 2006-239966

In order to lower the resistance of the common electrode interconnect, according to Patent Documents 1, 3 and 4, the common electrode interconnect is formed by a material having a low electric resistance to extend in a direction in which piezoelectric elements are aligned. However, it is said that the common electrode interconnect has a thickness less than or equal to 5 μm in any case. When the common electrode interconnect is as thin as such, it is necessary to have the dimension of the common electrode interconnect larger which results in a larger size of an inkjet head.

In order to downsize the inkjet head, on the other hand, it is necessary to make a thicker common electrode interconnect. However, according to the technique disclosed in Patent Documents 1, 3 and 4, the thickness of the common electrode interconnect is assumed to be about fpm in any case and a technique to thicken the common electrode interconnect to about 10 μm or more is not assumed. When forming a thicker layer, it may be difficult to form a layer having a uniform thickness. When the layer is not uniform, it is difficult to bond another substrate or the like to the layer. When forming an inkjet head by the MEMS process, as is described also in Patent Documents 1, 3 and 4, another substrate such as a support substrate or the like is to be bonded on the common electrode interconnect. Therefore, if the common electrode interconnect is not flat, the substrate cannot be properly bonded.

Further, when forming an inkjet head by the thin layer forming technique, ink channels are also formed by lithography and etching. For example, a vibration layer may be formed on one surface of a silicon substrate, and then ink channels and individual ink chambers are formed by etching the silicon substrate from its other surface. Etching may be performed by wet-etching or the like as disclosed in Patent Documents 2 and 3. When the ink channels are formed by this method at the same time with the individual ink chambers, the silicon substrate is etched to the extent where the vibration layer is exposed, and therefore, only the vibration layer is left on the ink channels although piezoelectric elements are formed on the vibration layer at the individual ink chambers. With this structure, when voltage is applied to one of the piezoelectric elements to actuate the piezoelectric element and the pressure on the ink in the corresponding individual ink chamber is increased, the pressure is also generated in the ink channel being in communication with the individual ink chamber to bend the vibration layer on the ink channel. Therefore, the vibration layer on the ink channel acts as a mechanical compliance component to release the pressure to lower the discharging efficiency. Further, in order to prevent the reverse flow of the ink from the individual ink chamber to the ink channel, it is necessary for the ink channel to be formed narrower than the individual ink chamber. In such a case, it is necessary for the width of the ink channel to be formed narrower than that of the individual ink chamber. Generally, when the width is narrower, etching rate becomes lower, and the height (depth) of the ink channel cannot be equal. In this case, it means that the mechanical compliance components vary for corresponding ink chambers to cause variance in pressure and variance in discharging amount.

For the above problem, according to Patent Document 2, as described above, piezoelectric layers are extended above the ink channel as enforcing layers to improve the rigidity of the vibration layer above the ink channels. Further, according to Patent Document 2, upper electrodes or a lower electrode contacting the piezoelectric layers are not formed on the ink channels to inactivate the piezoelectric layers in order to remove the influence on discharging.

SUMMARY OF THE INVENTION

The present invention is made in light of the above problems, and provides an inkjet head of a smaller size in which uniform discharging of ink is improved by lowering the resistance of a common electrode interconnect to reduce variance in mechanical compliance of ink channels even when the number of nozzles is large.

According to an embodiment, there is provided an inkjet head including a nozzle plate which is provided with plural nozzles aligned in a first direction, a channel substrate which is provided with plural individual ink chambers aligned in the first direction and corresponding to the plural nozzles and plural ink channels aligned in the first direction and corresponding to the plural nozzles such that each of the ink channels communicates with the corresponding nozzle through the corresponding individual ink chamber, the nozzle plate being bonded to one surface of the channel substrate; a multi-interconnect structure which is formed on the other surface of the channel substrate and a support substrate which is bonded to the channel substrate through the multi-interconnect structure. The multi-interconnect structure includes a vibration layer formed on the other surface of the channel substrate, plural piezoelectric elements formed on the vibration layer at areas corresponding to the plural individual ink chambers to be aligned in the first direction, each of the piezoelectric elements including a first electrode, a piezoelectric layer and a second electrode stacked in this order, the first electrode being a common electrode commonly provided for the plural piezoelectric elements and is extended to areas corresponding to the plural ink channels, and a common electrode interconnect electrically connected to the first electrode and formed at areas corresponding to the plural ink channels to be extending in the first direction, the common electrode interconnect including a first common electrode interconnect and a second common electrode interconnect which has a thickness thicker than that of the first common electrode interconnect. The support substrate is provided with a first concave portion at a surface facing the channel substrate at an area corresponding to the second common electrode interconnect to accommodate the second common electrode interconnect.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
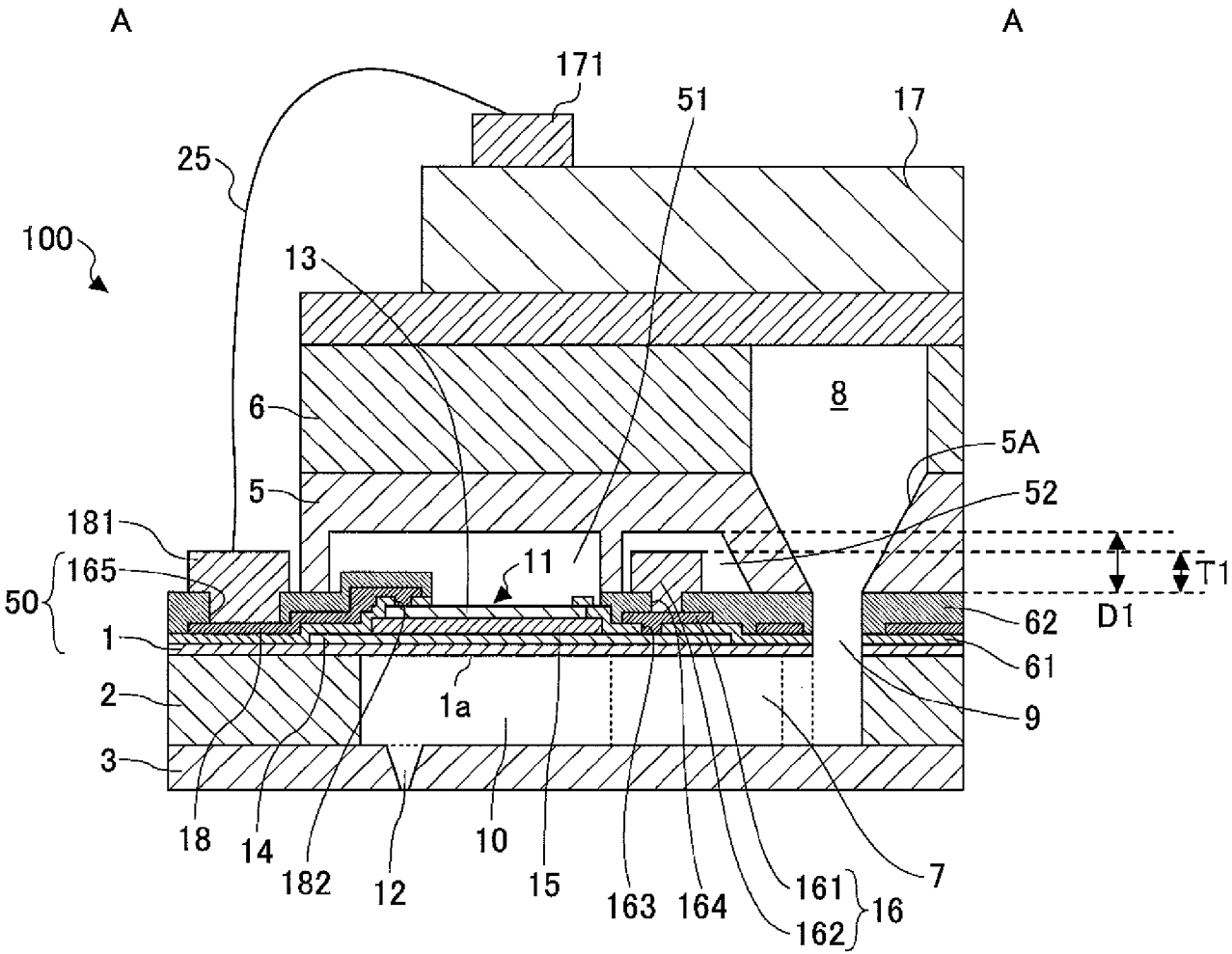
FIG. 1 is a cross sectional view showing an example of a part of an inkjet head of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

Next, embodiments of the present invention will be described below with reference to drawings.

It is to be noted that, in the explanation of the drawings, the same components are given the same reference numerals, and explanations are not repeated.

Figure 2:
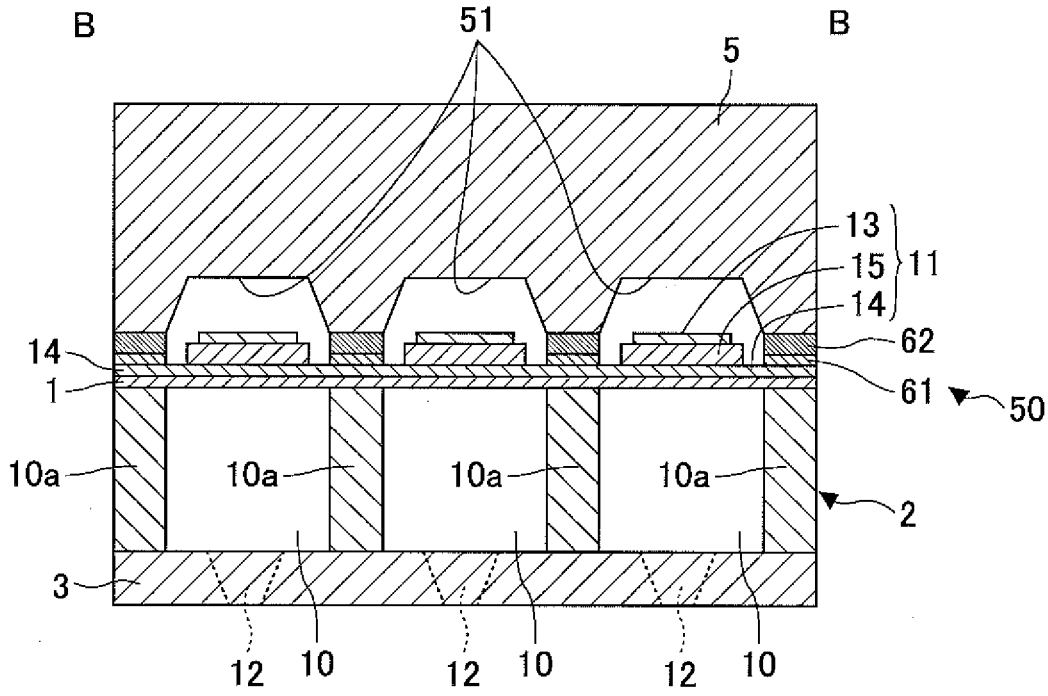
FIG. 2 is a cross sectional view showing an example of a part of an inkjet head of an embodiment.
Figure 3A:
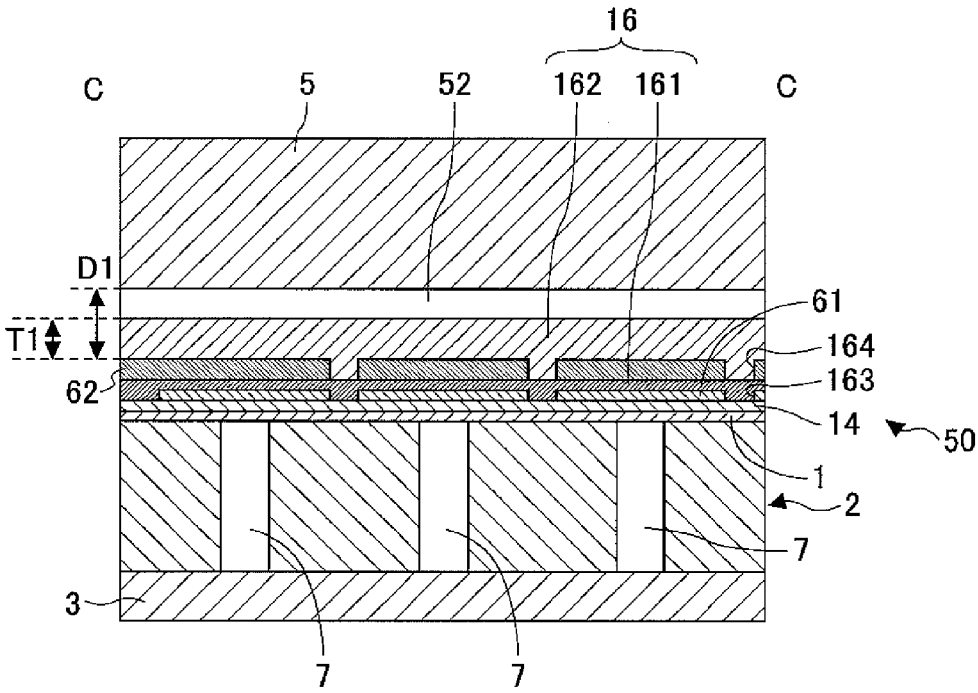
FIG. 3A is a cross sectional view showing an example of a part of an inkjet head of an embodiment.
Figure 4:
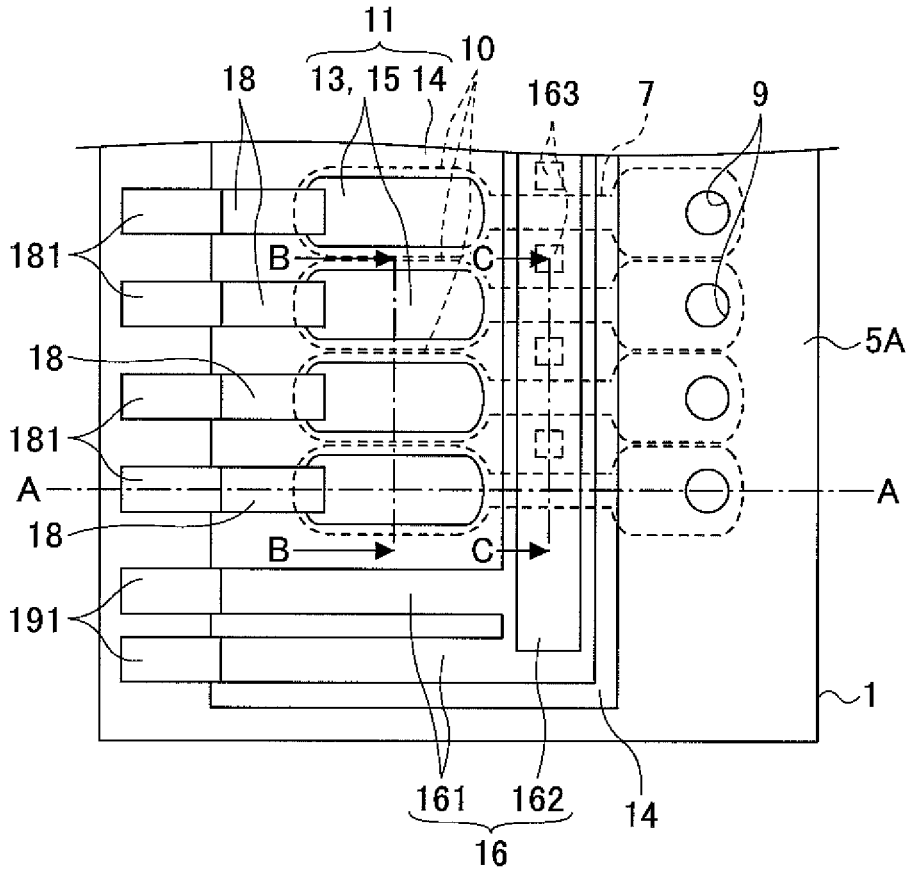
FIG. 4 is an upper plan view showing an example of a part of an inkjet head of an embodiment.

FIG. 1 is a cross sectional view showing an example of a part of an inkjet head 100 of an embodiment. FIG. 2 and FIG. 3A are also cross sectional views showing an example of a part of the inkjet head 100 of the embodiment. FIG. 4 is an upper plan view showing an example of a part of the inkjet head 100 of the embodiment. FIG. 5A to FIG. 5E are upper plan views showing a manufacturing process of an example of a part of the inkjet head 100 of the embodiment.

FIG. 1 corresponds to a cross-sectional view taken along an A-A line in FIG. 4, FIG. 2 corresponds to a cross-sectional view taken along a B-B line in FIG. 4, and FIG. 3A corresponds to a cross-sectional view taken along a C-C line in FIG. 4.

The inkjet head 100 includes a nozzle plate 3, a channel substrate 2, a multi-interconnect structure 50, a support substrate 5, a common ink chamber substrate 6, and a drive IC 17 including drive IC pads 171, formed in this order.

The nozzle plate 3 is provided with plural nozzles 12 for discharging ink. The nozzle plate 3 is bonded to one surface (lower surface) of the channel substrate 2.

The inkjet head 100 further includes a common ink chamber 8 which is in communication with an ink tank, not shown in the drawings and is provided at the common ink chamber substrate 6• and the support substrate 5, and plural ink supply ports 9 which are in communication with the common ink chamber 8 and are provided at the multi-interconnect structure 50 and the channel substrate 2.

The channel substrate 2 is provided with plural ink channels 7 and plural individual ink chambers 10.

As shown in FIG. 4, the ink supply ports 9, the ink channels 7, and the individual ink chambers 10 are aligned in a first direction (vertical direction in FIG. 4), respectively. Although not shown in FIG. 4, the nozzles 12 are respectively provided for the individual ink chambers 10 to be aligned in the first direction. Each of the ink supply ports 9, each of the ink channels 7, each of the individual ink chambers 10, and each of the nozzles 12 are in communication with each other.

The multi-interconnect structure 50 includes a vibration layer 1 which is formed on the other surface (upper surface) of the channel substrate 2, and plural piezoelectric elements 11, plural individual electrode interconnects 18, a common electrode interconnect 16, individual electrode pads 181, common electrode pads 191 (see FIG. 4) and insulating interlayers 61 and 62 (see FIG. 1), formed on the vibration layer 1. The vibration layer 1 is formed on the channel substrate 2 to cover the individual ink chambers 10 and the ink channels 7.

The inkjet head 100 further includes wirings 25 each connecting the corresponding drive IC pad 171 and the corresponding individual electrode pad 181 or the common electrode pad 191.

Each of the piezoelectric elements 11 includes a lower electrode 14 (first electrode), a piezoelectric layer 15 and an upper electrode 13 (second electrode) stacked in this order on the vibration layer 1. The lower electrode 14 is a common electrode commonly provided for the plural piezoelectric elements 11.

In this embodiment, the common electrode interconnect 16 includes a first common electrode interconnect 161 and a second common electrode interconnect 162 formed on the first common electrode interconnect 161.

Each of the piezoelectric elements 11 is actuated by applying voltage between the corresponding upper electrode 13 and the lower electrode 14. Application of the voltage is controlled by the drive IC 17. The voltage is applied from the corresponding drive IC pad 171 to the upper electrode 13 through the corresponding wiring 25, the individual electrode pad 181 and the individual electrode interconnect 18. Similarly, the voltage is applied from the corresponding drive IC pad 171 to the lower electrode 14 through the wiring 25, the common electrode pad 191 and the common electrode interconnect 16.

The support substrate 5 is bonded to the other surface of the channel substrate 2 through the multi-interconnect structure 50. The support substrate 5 is provided with a first concave portion 52 and plural second concave portions 51 at a surface facing the channel substrate 2. The first concave portion 52 is provided at an area corresponding to the second common electrode interconnect 162 to accommodate the second common electrode interconnect 162. The second concave portions 51 are provided at areas respectively corresponding to the plural piezoelectric elements 11 to give space for deformation of the vibration layer 1 when the piezoelectric elements 11 are actuated.

Ink is supplied to each of the individual ink chambers 10 from the ink tank, not shown in the drawings, through the common ink chamber 8, the ink supply port 9 and the ink channel 7.

When the ink is supplied in the individual ink chamber 10 and the piezoelectric element 11 formed above the individual ink chamber 10 is actuated, a pressure is applied in the individual ink chamber 10 to discharge the ink from the nozzle 12.

The individual ink chambers 10 function to apply pressure to the ink to be discharged from the nozzles 12.

(Nozzle Plate 3)

The nozzle plate 3 may be composed of a material selected based on required rigidity or processability. As for the material, for example, a metal or an alloy such as stainless steel (SUS), nickel or the like, silicon, an inorganic material such as ceramics or the like, a resin material such as polyimide or the like may be used.

The method of forming the nozzles 12 may be selected based on the characteristic of the material of the nozzle plate 3 and required accuracy and processability. The method may be etching, press working, laser processing, photolithography or the like, for example. The diameter of the nozzle 12, the number of nozzles 12, and the density of alignment may be appropriately set based on the requirement for the ink head 100.

(Channel Substrate 2)

The channel substrate 2 may be composed of material selected by considering the processability or the physical properties. The channel substrate 2 may be composed of a silicon substrate, for example. By using the silicon substrate, photolithography can be applied to form the ink channels 7, the individual ink chambers 10 and the like. Therefore, patterns of greater than or equal to 300 dpi (less than or equal to approximately 85 μm pitch) can be properly formed.

The individual ink chambers 10 and the ink channels 7 may be formed by any appropriate known method. For example, the individual ink chambers 10 and the ink channels 7 may be formed by photolithography including wet-etching or dry-etching. When the silicon substrate is used for the channel substrate 2, a surface 1*a* of the vibration layer 1 facing the individual ink chambers 10 may be a silicon oxide layer ($SiO_2$) or the like. In this case, the vibration layer 1 can function as an etching stopper layer when forming the individual ink chambers 10 and the ink channels 7 by etching, and the height of the individual ink chambers 10 and the ink channels 7 can be highly controlled.

FIG. 2 shows a structure of the individual ink chambers 10 and the piezoelectric elements 11 respectively provided on the individual ink chambers 10.

The individual ink chambers 10 are separated by divisional walls 10*a* composed of the channel substrate 2. The height of the individual ink chamber 10 may be 20 μm to 100 μm, for example, which may be equal to the thickness of the channel substrate 2. The width of the divisional wall 10*a* between the adjacent individual ink chambers 10 may be set depending on the density of the alignment. The width of the divisional wall 10*a* may be more than or equal to 10 μm, for example. With this size, even when the piezoelectric element 11 of the adjacent individual ink chamber 10 is actuated, mutual interference of the vibration can be prevented and the discharging can be properly controlled. The width of the divisional wall 10*a* may be less than or equal to 30 μm, for example. When the width of the divisional wall 10*a* is not large enough, the height of the individual ink chamber 10 may be lowered.

As shown in FIG. 2, the piezoelectric layers 15 and the upper electrodes 13 of the piezoelectric elements 11 are formed above the individual ink chambers 10, respectively. It means that the piezoelectric layers 15 are not formed on the divisional walls 10*a*. As the adjacent piezoelectric layers 15 are formed to have a predetermined interval, the influence of the adjacent piezoelectric element 11 can be prevented even when the piezoelectric element 11 is actuated. Therefore, the vibration layer 1 is properly deformed when the piezoelectric elements 11 is actuated to maintain the discharging efficiency or to reduce the concentration of stress so that the damage to the piezoelectric element 11 can be prevented.

FIG. 3A shows a structure of the ink channels 7.

In this embodiment, the piezoelectric elements 11 are not formed on the ink channels 7. Instead, only the lower electrode 14, the insulating interlayers 61 and 62, the first common electrode interconnect 161 and the second common electrode interconnect 162 are formed on the ink channels 7.

The ink channel 7 has a function to provide the ink to the corresponding individual ink chamber 10 from the common ink chamber 8 and a function to block reverse flow of the ink when the pressure is generated in the corresponding individual ink chamber 10 by actuating the piezoelectric element 11 to discharge the ink from the nozzle 12. Therefore, the ink channel 7 may be formed to be narrower than the individual ink chamber 10 so that the reverse flow of the ink from the individual ink chamber 10 can be prevented.

In this embodiment, the width of the ink channel 7 is formed to be narrower than that of the individual ink chamber 10 to form the ink channel 7 narrower than the individual ink chamber 10 so that the reverse flow of the ink from the individual ink chamber 10 can be prevented. FIG. 4 shows the shape of the ink channels 7 and the individual ink chambers 10 by dotted lines.

Further, in this embodiment, the height of the ink channels 7 is formed to be equal to that of the individual ink chambers 10, which may also be equal to the thickness of the channel substrate 2. When the channel substrate 2 is composed of silicon, and the individual ink chambers 10 and the ink channels 7 are formed by photolithography (and etching), the ink channels 7 can be formed by the same condition as that of the individual ink chambers 10 if the heights of the ink channels 7 and the individual ink chambers 10 are the same. In other words, according to this embodiment, because the whole depth of the channel substrate 2 is etched from the one surface of the channel substrate 2 until the vibration layer 1 is exposed, the heights of the ink channels 7 and the individual ink chambers 10 can be controlled to be equal.

If the height of the ink channel 7 is formed to be lower than that of the individual ink chamber 10 in order to form the ink channel 7 narrower than the individual ink chamber 10, etching of the ink channels 7 may be terminated at a predetermined period so as not to etch the whole depth of the channel substrate 2. Therefore, there may be a variance in the etching amount because of the variance in the etching rate. When the etching amount is not equal for the plural ink channels 7, the flow resistance cannot be equal for the plural ink channels 7.

Further, when the width of the ink channel 7 is formed to be as wide as that of the individual ink chamber 10, the dimension of the vibration layer 1 formed above the ink channel 7 becomes larger and as the piezoelectric element 11 is not formed on the ink channel 7, the vibration layer 1 above the ink channel 7 functions as a mechanical compliance component to reduce the discharging efficiency of the ink.

The first common electrode interconnect 161 and the second common electrode interconnect 162 of the common electrode interconnect 16 are formed on the ink channels 7. Therefore, the rigidity of the vibration layer 1 above the ink channels 7 is enforced so that the variation of the mechanical compliance for the plural piezoelectric elements 11 can be reduced.

Further, according to this embodiment, as shown in FIG. 4, each of the ink channels 7 may have a portion with a broader width at the end opposite to the individual ink chamber 10 where the ink supply port 9 is formed.

(Multi-Interconnect Structure 50)

Here, the method of manufacturing the multi-interconnect structure 50 is also explained with reference to FIG. 5A to FIG. 5E.

Figure 5A:
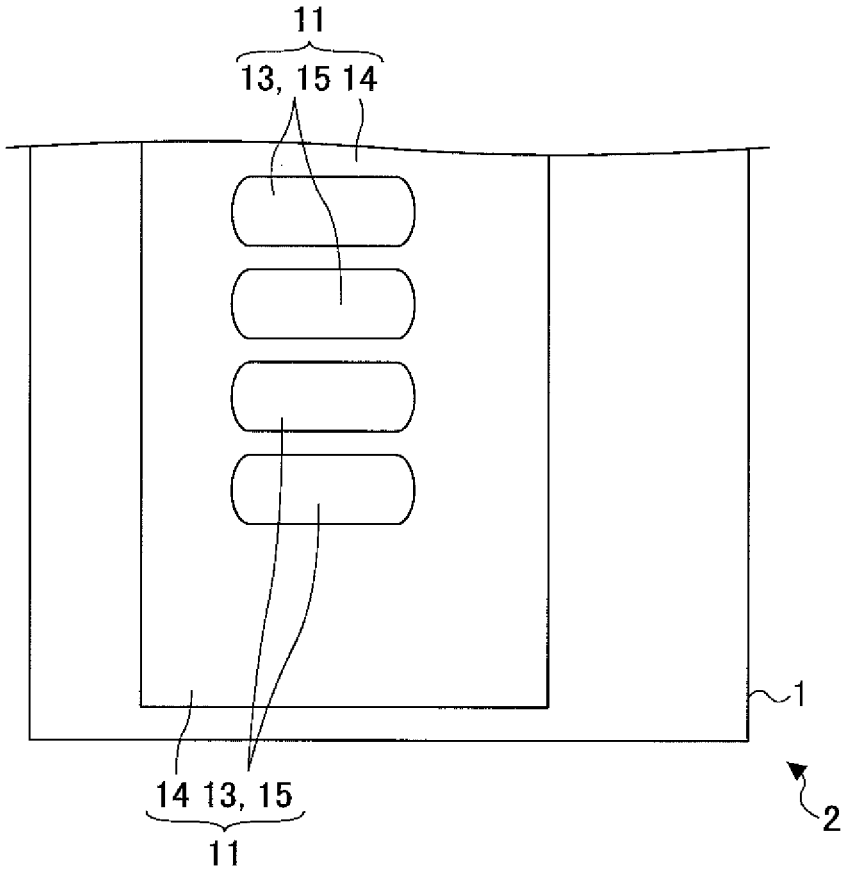
FIG. 5A to FIG. 5E are upper plan views showing a manufacturing process of an example of a part of an inkjet head of an embodiment.

First, the vibration layer 1 is formed on the entire surface of the channel substrate 2 (see FIG. 5A).

The vibration layer 1 may be an insulating interlayer. For the vibration layer 1, a material having a high rigidity such as silicon nitride, silicon oxide, silicon carbide or the like may be used, for example. A stacked structure of these layers may be used as well. When the stacked structure is used, internal stress of each of the layers may be considered such that the remaining stress in the stacked structure is reduced. For example, when a stacked structure of $Si_3N_4$ layer having tensile stress and $SiO_2$ layers having compression stress is used, the $SiO_2$ layer and the $Si_3N_4$ layer may be alternately stacked to reduce the stress.

The thickness of the vibration layer 1 may be selected based on required characteristics.

For example, the thickness of the vibration layer 1 may be more than or equal to 0.5 μm and more preferably, may be more than or equal to 1.0 μm. By forming the vibration layer 1 with such a thickness, the vibration layer 1 is not damaged by cracking or the like. Further, by forming the vibration layer 1 with such a thickness, natural frequency of the vibration layer 1 can be maintained and the driving frequency can be increased.

Further, for example, the thickness of the vibration layer 1 may be less than or equal to 10 μm and more preferably, may be less than or equal to 5.0 μm. By forming the vibration layer 1 with such a thickness, the variation amount can be controlled and the discharging efficiency of the ink can be improved.

Then, the lower electrode 14 is formed as a plane electrode on the vibration layer 1 (see FIG. 5A). Thereafter, the piezoelectric layers 15 are patterned on the lower electrode 14. Then, the upper electrodes 13 are respectively formed on the piezoelectric layers 15 so that the piezoelectric elements 11 are formed. FIG. 5A shows this status.

The upper electrode 13 and the lower electrode 14 may be composed of a conductive material such as a metal, an alloy, conductive compounds or the like having a lower resistance value, for example.

The upper electrode 13 and the lower electrode 14 may be composed of a material having a high stability such as Pt, Ir, Ir oxide, Pd, Pd oxide or the like, for example. The upper electrode 13 and the lower electrode 14 may be composed of same materials or by different materials.

The upper electrode 13 and the lower electrode 14 may be composed of a material with a high stability so as not to react with the piezoelectric layer 15 or not to be diffused into the piezoelectric layer 15.

Further, diffusion barrier layers may be provided between the vibration layer 1 and the lower electrode 14, between the lower electrode 14 and the piezoelectric layer 15, or between the piezoelectric layer 15 and the upper electrode 13.

Further, adhesion layers may be provided between the vibration layer 1 and the lower electrode 14, between the lower electrode 14 and the piezoelectric layer 15, or between the piezoelectric layer 15 and the upper electrode 13 to improve the corresponding layers. The adhesion layer may be composed of Ti, Ta, W, Cr or the like, for example.

The thickness of the upper electrode 13 and the lower electrode 14 may be properly set but may be less than or equal to 1 μm. The upper electrode 13 and the lower electrode 14 may be formed by a method capable of forming a flat layer such as chemical vapor deposition, physical vapor deposition or the like.

The piezoelectric layer 15 may be composed of a material such as ferroelectrics having piezoelectric properties such as lead zirconate titanate (PZT), barium titanate or the like, for example. The piezoelectric layer 15 may be formed by, for example, sputtering, sol-gel method or the like. By using sol-gel method, the piezoelectric layer 15 can be formed at a low temperature.

As is described with referring to FIG. 4, the upper electrodes 13 and the piezoelectric layers 15 are individually patterned with respect to the individual ink chambers 10. Patterning of the upper electrodes 13 and the piezoelectric layers 15 may be performed using photolithography technique. When the piezoelectric layer 15 is formed by sol-gel method, spin coating or printing may be used for patterning.

Each of the individual electrode interconnects 18 is electrically connected to the respective upper electrode 13 for inputting a drive signal into the piezoelectric element 11 aligned above the individual ink chamber 10. The common electrode interconnect 16 is electrically connected to the lower electrode 14.

As shown in FIG. 4, the individual electrode interconnects 18 are extended from the respective upper electrodes 13 to one edge (left edge) of the channel substrate 2 where the individual electrode pads 181 are formed.

The lower electrode 14 is formed to extend above the ink channels 7 near the ink supply ports 9 provided at the opposite edge (right edge) of the channel substrate 2.

Then, the insulating interlayer 61 (not shown in FIG. 5A but shown in FIG. 1) is formed on the upper electrodes 13, the lower electrode 14 and the vibration layer 1. Then, contact holes 163 (shown also in FIG. 1 for explanation purpose) and the contact holes 182 are formed in the insulating interlayer 61 to exposed parts of the lower electrode 14 and the upper electrodes 13.

Figure 5B:
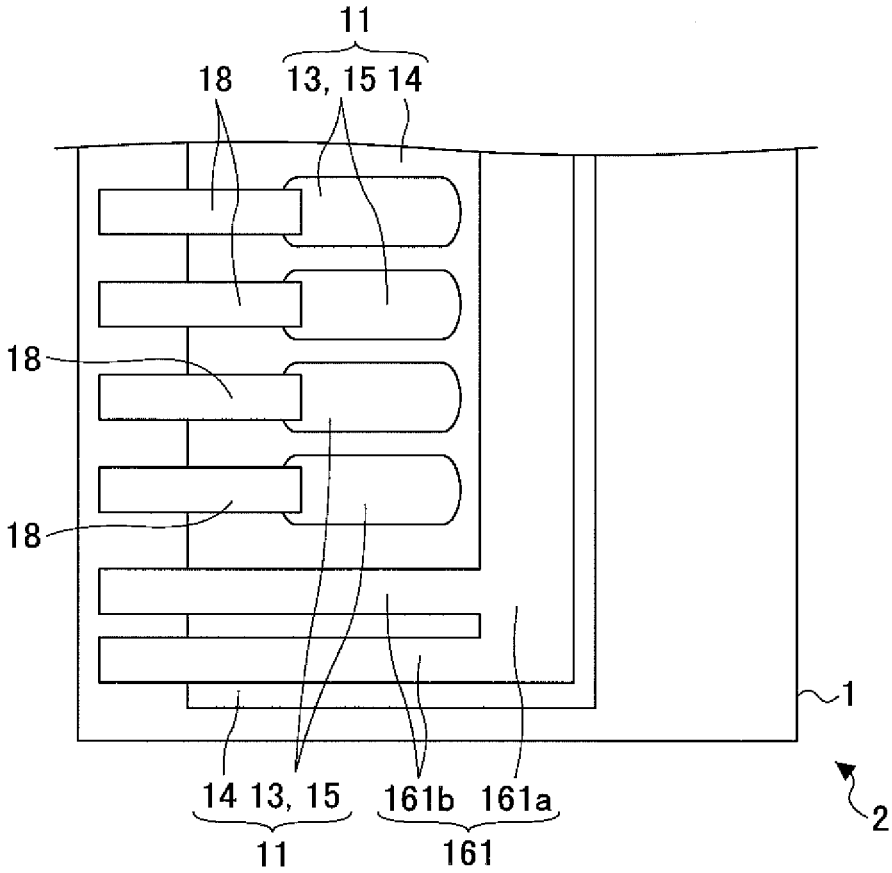

Subsequently, the first common electrode interconnect 161 and the individual electrode interconnects 18 are formed on the insulating interlayer 61 (FIG. 5B). At this time, the material composing the first common electrode interconnect 161 and the individual electrode interconnects 18 is respectively formed in the contact holes 163 and the contact holes 182 formed in the insulating interlayer 61, so that contacts for electrically connecting the first common electrode interconnect 161 and the lower electrode 14, and the individual electrode interconnects 18 and the upper electrodes 13, respectively, are formed.

The individual electrode interconnects 18 and the first common electrode interconnect 161 may be composed of a material having a low resistance such as Al, Au, Ag, Pd, Ir, W, Ti, Ta, Cu, Cr or the like, for example. The individual electrode interconnects 18 and the first common electrode interconnect 161 may be composed of a single layer of the above material or a stacked structure of layers of the above materials in order to reduce the contact resistance. As for a material to reduce the contact resistance, a conductive compound such as an oxide compound, a nitride compound or a complex compound of these such as $Ta_2O_5$, $TiO_2$, TiN, ZnO, $In_2O_2$, SnO, or the like may be used, for example.

The thickness of the individual electrode interconnects 18 and the first common electrode interconnect 161 may be properly set but may be less than or equal to 1 μm. The individual electrode interconnects 18 and the first common electrode interconnect 161 may be formed by a method capable of forming a flat layer such as chemical vapor deposition, physical vapor deposition or the like.

In this embodiment, as shown in FIG. 5B, the first common electrode interconnect 161 includes a first portion 161*a* extending in a first direction (vertical direction in FIG. 5B) in which the individual ink chambers 10 and the piezoelectric elements 11 (the upper electrodes 13 and the piezoelectric layers 15) are aligned, and second portions 161*b* extending in a second direction (lateral direction in FIG. 5B) crossing the first direction. In this embodiment, the second direction is perpendicular to the first direction. Further, in this embodiment, the second direction is the extending direction of the individual electrode interconnect 18. The second portions 161*b* of the first common electrode interconnect 161 which is electrically connected to the lower electrode 14 is extended to the one edge (left edge) of the channel substrate 2 where the common electrode pads 191 are formed (see FIG. 5C).

By forming the plural second portions 161*b* of the first common electrode interconnect 161 the resistance of the first common electrode interconnect 161 can be reduced. However, the first common electrode interconnect 161 may include a single second portion 161*b*. Further, the first common electrode interconnect 161 may include other second portions 161*b* at the opposite end of the first portion 161*a*.

Then, the insulating interlayer 62 (not shown in FIG. 5C but shown in FIG. 1) is formed on the individual electrode interconnects 18 and the first common electrode interconnect 161.

In this embodiment, the insulating interlayer 61 or the insulating interlayer 62 may be composed of a material generally used for an insulating interlayer. The insulating interlayer 61 or the insulating interlayer 62 may be composed of a stacked structure of plural insulating layers.

Then, contact holes 164 and the contact holes 165 are formed in the insulating interlayer 62 to expose parts of the first common electrode interconnect 161 and the individual electrode interconnects 18.

Figure 5C:
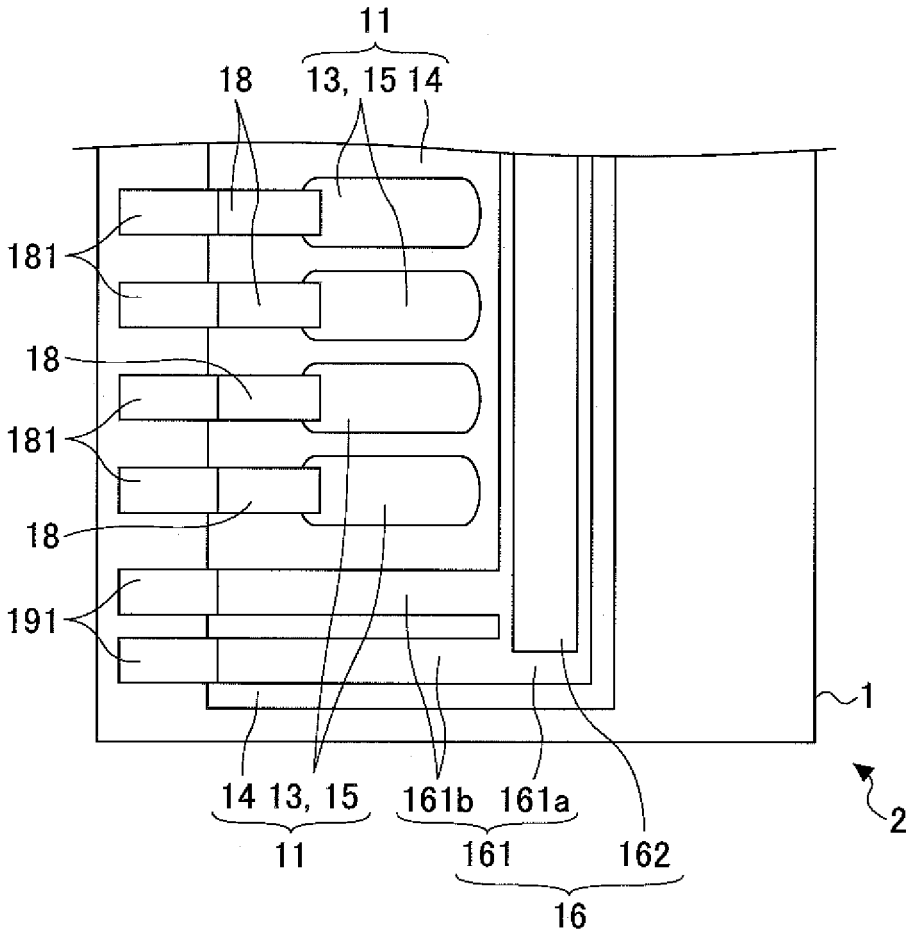

Subsequently, the second common electrode interconnect 162, the common electrode pads 191 and the individual electrode pads 181 are formed respectively on the first portion 161*a* of the first common electrode interconnect 161, the second portions 161*b* of the first common electrode interconnect 161 and the individual electrode interconnects 18. At this time, the material composing the second common electrode interconnect 162 is formed in the contact holes 164 which are formed in the insulating interlayer 62 so that contacts for electrically connecting the second common electrode interconnect 162 and the first common electrode interconnect 161 are formed. Similarly, at the same time, the material composing the common electrode pads 191 and the individual electrode pads 181 is formed in the contact holes 164 formed in the insulating interlayer 62 so that contacts for electrically connecting the common electrode pads 191 and the individual electrode pads 181 with the second portions 161*b* of the first common electrode interconnect 161 and the individual electrode interconnects 18, respectively (FIG. 5C).

As described above, the common electrode pads 191 and the individual electrode pads 181 are exposed at the upper surface of the channel substrate 2 and connected to the drive IC pads 171 of the drive IC 17 through wirings 25, respectively.

The second common electrode interconnect 162 is formed on the first portion 161*a* of the first common electrode interconnect 161 to be electrically connected to the first common electrode interconnect 161. By forming the second common electrode interconnect 162 on the first common electrode interconnect 161, the resistance of the common electrode interconnect 16 is lowered.

As described above, the first common electrode interconnect 161 and the individual electrode interconnects 18 may be formed by a same material at the same time. The second common electrode interconnect 162, the common electrode pads 191 and the individual electrode pads 181 may be formed of a same material at the same time.

The interconnects, the electrodes and the pads may be composed of materials such as a metal, an alloy, conductive materials or the like having a low resistance.

The second common electrode interconnect 162 functions to reduce the resistance value of the common electrode interconnect 16. As shown in FIG. 5C, the second common electrode interconnect 162 is formed to extend in the first direction (vertical direction in FIG. 5C) in which the individual ink chambers 10 and the piezoelectric elements 11 (the upper electrodes 13 and the piezoelectric layers 15) are aligned on the first portion 161*a* of the first common electrode interconnect 161 which is also extending in the same direction.

The first common electrode interconnect 161 and the second common electrode interconnect 162 are necessary to be electrically connected, and may be formed by materials, the combination of which has a low contact resistance. The material for the second common electrode interconnect 162 may be a metal, an alloy, conductive compounds or the like having a low resistance. Further, as the second common electrode interconnect 162 needs to be thicker to lower the resistance of the common electrode interconnect 16 having a small dimension, the second common electrode interconnect 162 may be composed of a material capable of forming a thicker film and may be formed by a method capable of forming a thicker film. The thickness of the second common electrode interconnect 162 may be more than or equal to 10 μm. The thickness of the second common electrode interconnect 162 may be less than or equal to 100 μm and more preferably less than or equal to 50 μm. The second common electrode interconnect 162 may be formed by plating such as electrolytic plating, electroless plating or the like, printing such as screen printing, gravure printing, flexographic printing or the like, or the like, for example. The second common electrode interconnect 162 may be composed of a metal or an alloy selected from a group including Au, Ag, Cu, Ni Cr and the like. The second common electrode interconnect 162 may be formed by a method and a material by which the remaining stress after forming the layer is small.

As shown in FIG. 5C, by forming the second common electrode interconnect 162 on the first common electrode interconnect 161, the resistance of the common electrode interconnect 16 is lowered and voltage drop can be prevented so that discharging uniformity can be obtained.

(Support Substrate 5)

As described above, the thickness of the channel substrate 2 is about 20 to 100 μm. Therefore, in order to maintain the rigidity of the channel substrate 2, the support substrate 5 is bonded to the upper side of the channel substrate 2 through the multi-interconnect structure 50 so that the channel substrate 2 is interposed between the nozzle plate 3 and the support substrate 5.

The support substrate 5 may be composed of material having a thermal expansion coefficient close to that of the channel substrate 2 such as glass, silicon, or ceramics such as $SiO_2$, $ZrO_2$, $Al_2O_3$ or the like in order to prevent warping of the channel substrate 2. The support substrate 5 is provided with an opening 5A for forming the common ink chamber 8. The opening 5A is connected to the ink supply ports 9 of the channel substrate 2.

As shown in FIG. 2, the second concave portions 51 formed in the support substrate 5 are individually provided for each of the individual ink chambers 10. The support substrate 5 contacts the multi-interconnect structure 50 at areas between the adjacent second concave portions 51 to separate the plural second concave portions 51 from each other. With this structure, the rigidity of the channel substrate 2 can be increased even when the channel substrate 2 is not so thick. Further, mutual interference between the adjacent individual ink chambers 10 when the piezoelectric element 11 is actuated can be reduced with this structure.

As shown in FIG. 1 or FIG. 3A, the depth D1 of the first concave portion 52 of the support substrate 5 is greater than the thickness T1 of the second common electrode interconnect 162. The depth D1 of the first concave portion 52 of the support substrate 5 may be 10 μm to 30 μm longer than the thickness T1 of the second common electrode interconnect 162.

Further, the first concave portion 52 and the second concave portions 51 of the support substrate 5 may be separately provided so that the support substrate 5 can contact the multi-interconnect structure 50 at the area between the first concave portion 52 and each of the second concave portions 51. With this structure, the rigidity of the ink channel 7 can be improved.

By forming the first concave portion 52 in the support substrate 5, even when the thicker second common electrode interconnect 162 which may have uneven surfaces is formed on the first common electrode interconnect 161, the support substrate 5 can be bonded to the channel substrate 2 through the multi-interconnect structure 50 without contacting the second common electrode interconnect 162. Therefore, the support substrate 5 can contact the flat surface of the multi-interconnect structure 50 to maintain ink sealing for the inkjet head 100.

Further, the adhesive to bond the support substrate 5 to the multi-interconnect structure 50 can be thinner.

Figure 5D:
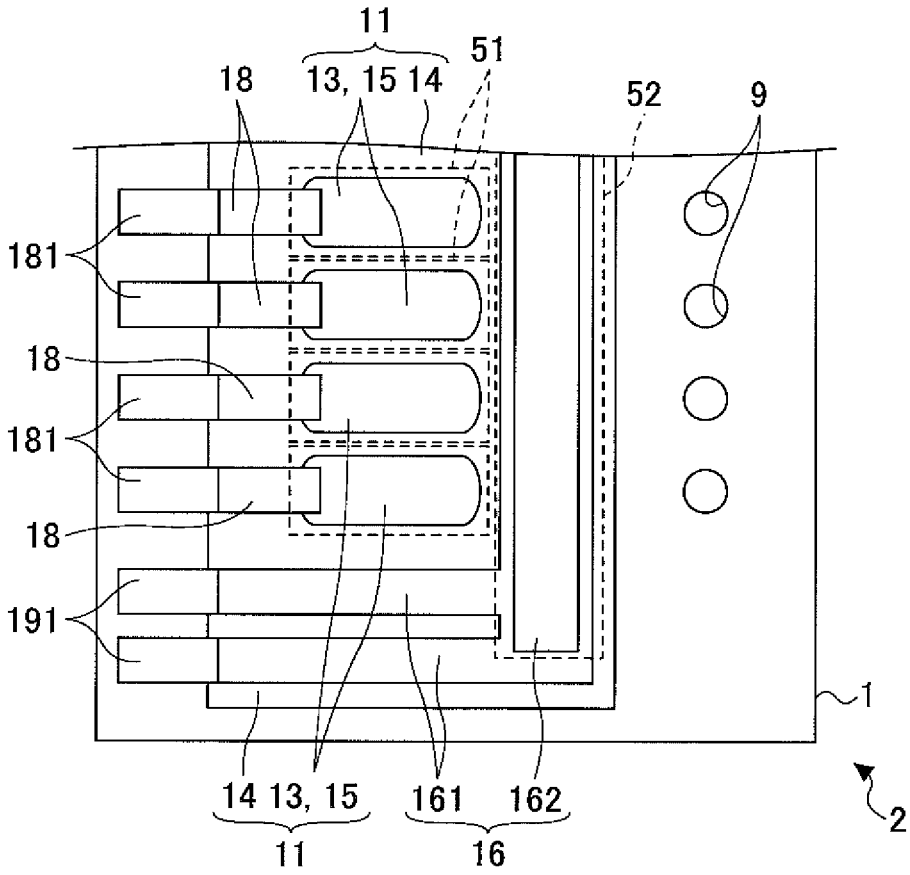

FIG. 5D shows the shape of the first concave portion 52 and the second concave portions 51 by dotted lines. The area not surrounded by the dotted lines becomes a bonding surface of the multi-interconnect structure 50 bonded to the support substrate 5.

As shown in FIG. 5D and FIG. 5C, the second common electrode interconnect 162 is not formed on the second portions 161*b* of the first common electrode interconnect 161 extending in the lateral direction (second direction) and the support substrate 5 contacts the multi-interconnect structure 50 at an area corresponding to the second portions 161*b* of the first common electrode interconnect 161. In other words, the second common electrode interconnect 162 is selectively formed on the first portion 161*a* of the first common electrode interconnect 161 extending in the vertical direction (first direction). Further the second portions 161*b* of the first common electrode interconnect 161 may be formed at the edge (lower edge in FIG. 5D and FIG. 5C) on the channel substrate 2. With this structure, the support substrate 5 can contact with the surface of the multi-interconnect structure 50 at the edge so that the bonding can be ensured.

Before bonding support substrate 5 to the channel substrate 2, the ink supply ports 9 are formed in the multi-interconnect structure 50 by dry-etching or the like (FIG. 5D). Thereafter, the support substrate 5 is bonded to the channel substrate 2. Then, the one surface (lower surface in FIG. 1) of the channel substrate 2 is grinded to a predetermined thickness. Subsequently, the individual ink chambers 10 and the ink channels 7 as described above are formed in the channel substrate 2 by dry-etching or the like until the vibration layer 1 is exposed so that the heights of the ink channels 7 and the individual ink chambers 10 are the same.

Figure 5E:
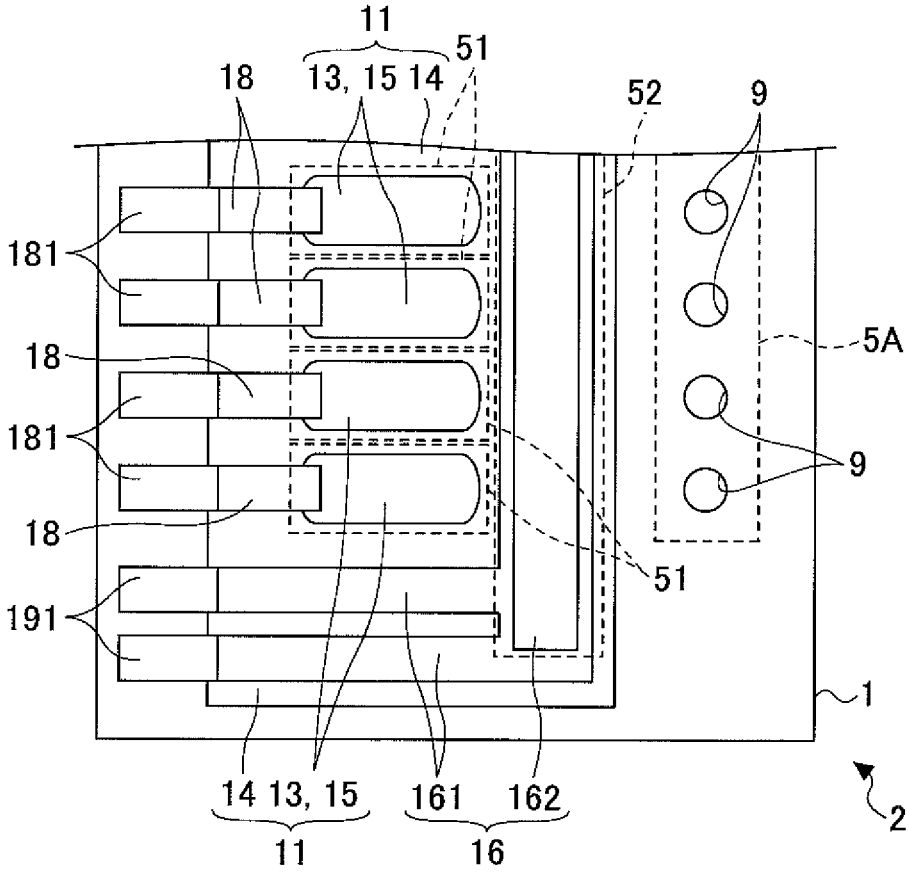

Thereafter, after cutting the channel substrate 2 and the support substrate 5 into chips by dicing, the nozzle plate 3 and the channel substrate 2 are bonded. Then, the common ink chamber substrate 6 is bonded on the support substrate 5 to connect the common ink chamber 8 to the ink tank, not shown in the drawings. FIG. 5E shows the shape of the opening 5A (the common ink chamber 8) by a dotted line.

Subsequently, the drive IC 17, on which the drive IC pads 171 are formed is mounted on the common ink chamber substrate 6.

As shown in FIG. 1, the wirings 25 are connected to the individual electrode pads 181 and the common electrode pads 191, and the drive IC pads 171 of the drive IC 17 for inputting signals from the drive IC 17. Although in this embodiment, the pads are connected by wire bonding, connection of the pads may be performed by any other method such as Anisotropic Conductive Film (ACF) bonding using Flexible Print Circuit (FPC), soldering, flip chip by which output terminals of the drive IC 17 are directly connected to the individual electrode pads 181 or the common electrode pads 191, or the like. Materials and the structure of the pads are selected based on the selected connecting method.

Figure 3B:
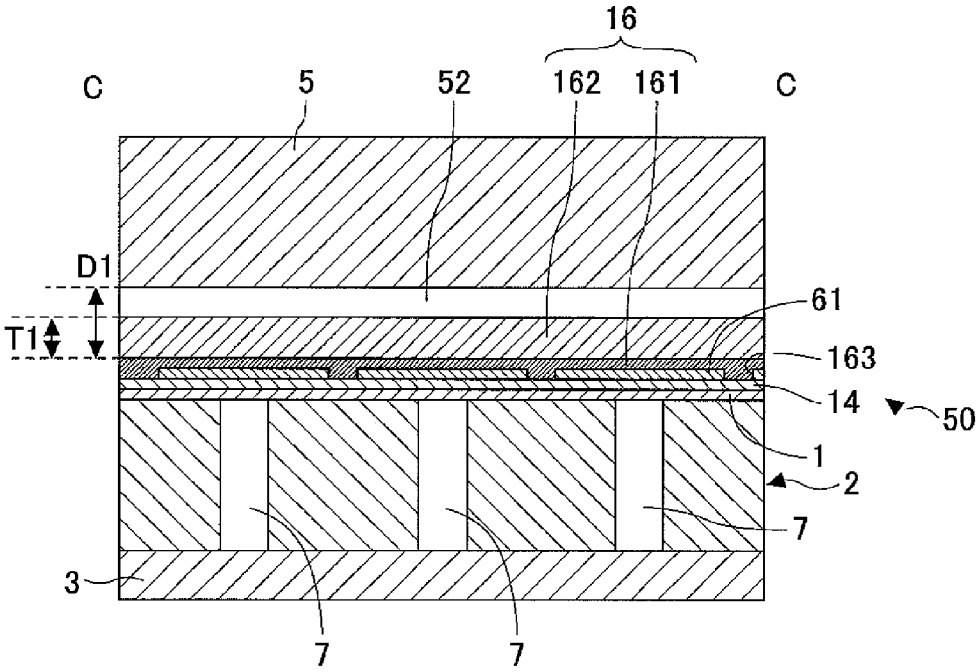
FIG. 3B is a cross sectional view showing another example of a part of an inkjet head of an embodiment.

Further, although the embodiment where the insulating interlayer 62 is provided between the first common electrode interconnect 161 and the second common electrode interconnect 162 is explained in the above, the multi-interconnect structure 50 may not include the insulating interlayer 62 as shown in FIG. 3B. In FIG. 3B, the second common electrode interconnect 162 is directly formed on the first common electrode interconnect 161. When the second common electrode interconnect 162 is formed by printing or the like and it is not necessary to pattern the second common electrode interconnect 162 by etching or the like, this structure may be used, for example.

EXAMPLE 1

For the channel substrate 2, a silicon wafer of ϕ6 inch and having a thickness of 600 μm was used. Then, the vibration layer 1 composed of a stacked structure of $SiO_2$ layer (0.6 μm thickness), Si layer (1.5 μm thickness) and $SiO_2$ layer (0.4 μm thickness) stacked in this order was formed on the silicon wafer. Thereafter, for the lower electrode 14, a stacked structure of Ti layer (20 nm thickness) and Pt layer (200 nm thickness) was formed by sputtering. Then, the piezoelectric layer 15 composed of PZT (2 μm thickness) was formed on the lower electrode 14 by a sol-gel method using lead zirconate titanate (PZT) to form a layer and to bake it at approximately 700° C. Subsequently, the upper electrode 13 composed of Pt was formed on the piezoelectric layer 15 by sputtering Pt for 200 nm.

After forming the upper electrode 13, the upper electrode 13, the piezoelectric layer 15 and the lower electrode 14 were patterned by dry-etching to form individual piezoelectric elements 11.

The alignment pitch of the piezoelectric elements 11 in the first direction was 85 μm, the width of each of the piezoelectric layers 15 was 50 μm. The length of the piezoelectric element 11 in the longitudinal direction was 1000 μm. The number of piezoelectric elements 11 was 300.

After forming the piezoelectric element 11, the insulating interlayer 61 was formed by plasma CVD. Then, the contact holes 182 and the contact holes 163 were formed in the insulating interlayer 61 to expose the upper surface of the upper electrodes 13 and the lower electrode 14, respectively.

Then, the first common electrode interconnect 161 and the individual electrode interconnects 18 were formed on the insulating interlayer 61. In this example, the first common electrode interconnect 161 and the individual electrode interconnects 18 were composed of Ti layer (50 nm) and Al layer (500 nm) formed in this order. Subsequently, the Ti layer and the Al layer were patterned by dry-etching to form the first common electrode interconnect 161 and the individual electrode interconnects 18. The pattern of the electrodes was the same as shown in FIG. 5B. The width of the first common electrode interconnect 161 was 300 μm.

Thereafter, a part of the vibration layer 1 (multi-interconnect structure 50) corresponding to the ink supply ports 9 are removed by dry-etching.

Then, the second common electrode interconnect 162, the common electrode pads 191 and the individual electrode pads 181 were formed on the first common electrode interconnect 161 or on the individual electrode interconnects 18. In this example, the second common electrode interconnect 162, the common electrode pads 191 and the individual electrode pads 181 were composed of Ag paste formed by screen printing. The thickness of the second common electrode interconnect 162 was 20 μm and the width of the second common electrode interconnect 162 was 200 μm.

For the support substrate 5, a silicon wafer of ϕ6 inch was used. The first concave portion 52 and the second concave portions 51 having a depth of 30 μm were formed by inductively coupled plasma (ICP) dry-etching. The opening 5A was formed by sandblasting.

Epoxy adhesive having a thickness of 2 μm was coated at the bonding surface of the support substrate 5 by a flexographic printer and then the support substrate 5 was bonded to the channel substrate 2 by curing the epoxy adhesive. Thereafter, after grinding the lower surface of the channel substrate 2 having the thickness of 600 μm to 80 μm, the individual ink chambers 10 and the ink channels 7 shown in FIG. 1 and FIG. 4 were formed by ICP dry-etching.

The width of the individual ink chamber 10 was 60 μm, the width of the ink channel 7 was 30 μm and the length of the ink channel 7 was 300 μm. The ink channels 7 and the individual ink chambers 10 were formed by etching the channel substrate 2 until the vibration layer 1 was exposed so that the heights of the ink channels 7 and the individual ink chambers 10 are the same. Further, as the ink supply ports 9 are previously formed in the vibration layer 1 (multi-interconnect structure 50), the through holes can be formed.

After cutting the wafer into chips by dicing, the nozzle plate 3 and the channel substrate 2 were bonded by similar method as the support substrate 5. For the nozzle plate 3, SUS (stainless steel) with a thickness of 30 μm was used for which nozzles 12 of ϕ20 μm at 85 μm pitch were formed by press working.

Then, as shown in FIG. 1, the common ink chamber substrate 6 composed of SUS (stainless steel) is bonded on the support substrate 5 to connect the common ink chamber 8 to the ink tank, not shown in the drawings. Subsequently, the drive IC 17, on which the drive IC pads 171 were formed, was mounted on the common ink chamber substrate 6 by Anisotropic Conductive Film (ACF). Then, the drive IC pads 171 and the individual electrode pads 181 or the common electrode pads 191 are electrically connected by Tape Automated Bonding (TAB) to form the inkjet head 100.

After ink with a viscosity of 8 mPa was pumped to the individual ink chambers 10 from the ink tank, not shown in the drawings, a voltage of 20V having a pulse length 10 μs and frequency of 1 kHz was applied between the individual electrode interconnect 18 and the common electrode interconnect 16. Then, the drop speed of the discharged ink was measured by a flash camera.

As a result, the drop speed of the discharged ink of the piezoelectric element 11 closest to the common electrode pad 191 was 7.2 m/s, and the drop on speed of the discharged ink of the piezoelectric element 11 farthest (for 300 pitch) from the common electrode pad 191 was 7.1 m/s. These results are almost the same and within an acceptable error range. It means that the discharging uniformity can be obtained. It also means that the resistance of the common electrode interconnect 16 is low enough to not cause voltage drop.

Further, the variance in the drop speed when the adjacent piezoelectric element 11 is actuated was within ±2%. It means that the rigidity of the vibration layer 1 on the ink channels 7 was high enough not to cause variance in mechanical compliance.

RELATIVE EXAMPLE 1

In this relative example, an inkjet head was formed in accordance with a similar method as example 1. However, in this relative example, the second common electrode interconnect 162 was not formed.

Then, the drop speed of the discharged ink was measured by the flash camera similarly as example 1.

As a result, an average drop speed of the discharged ink of all of the piezoelectric element 11 was lowered to 6.8 m/s. Further, the variance in the drop speed between the piezoelectric element 11 closest to the common electrode pad 191 and the piezoelectric element 11 farthest (for 300 pitch) from the common electrode pad 191 was ±15%. Further, the variance in the drop speed when the adjacent piezoelectric element 11 is actuated became larger (about 10%) than that of example 1.

It means that the resistance of the common electrode interconnect 16 cannot be lowered enough so that a voltage drop was generated. Further, the function of the vibration layer 1 above the ink channels 7 as the mechanical compliance components cannot be prevented. Further, mutual interference between adjacent piezoelectric elements 11 cannot be prevented.

EXAMPLE 2

In this example, an inkjet head 100 was formed in accordance with a similar method as example 1. However, in this example, the insulating interlayer 62 was formed between the first common electrode interconnect 161 and the second common electrode interconnect 162.

After patterning the individual electrode interconnects 18 and the first common electrode interconnect 161, $Si_3N_4$ (2 μm thickness) was formed as the insulating interlayer 62 by plasma CVD. Then, the contact holes 164 in which contacts for electrically connecting the second common electrode interconnect 162 and the first common electrode interconnect 161 and the contact holes 165 in which contacts for connecting the common electrode pads 191 and the first common electrode interconnect 161, and the individual electrode pads 181 and the individual electrode interconnects 18 are formed were formed in the insulating interlayer 62 by dry-etching.

Then, by forming a Ni layer (20 μm thickness) on the insulating interlayer 62 and then substituting the surface of the Ni layer with about 0.5 μm of Au by electroless plating, the common electrode pads 191, the individual electrode pads 181, and the second common electrode interconnects 162 were formed at the same time.

Subsequently, the drop speed of the discharged ink was measured by the flash camera similarly as example 1.

As a result, the variance in the drop speed between the piezoelectric element 11 closest to the common electrode pad 191 and the piezoelectric element 11 farthest (for 300 pitch) from the common electrode pad 191 was almost the same as that of example 1.

Further, the variance in the drop speed when the adjacent piezoelectric element 11 is actuated was within ±1.5%, which is lower than that (±2%) of example 1. It can be understood that according to example 2, the vibration layer 1 is enforced by the insulating interlayer 62 composed of $Si_3N_4$ having a high rigidity to reduce the mutual interference. Further, it can also be understood that the vibration layer 1 may further be enforced by the Ni layer, having a high rigidity, of the second common electrode interconnects 162.

Further, according to the method of example 2, as Au plating layers are formed at the surfaces of the common electrode pads 191 and the individual electrode pads 181 when forming the second common electrode interconnects 162, it is not necessary to additionally perform plating for connecting the wirings 25 as shown in FIG. 1.

According to the inkjet head 100 of the embodiment, the common electrode interconnect 16, which is electrically connected to the lower electrode 14 further extending over the ink channels 7 from the piezoelectric element 11 is composed of a stacked structure of the first common electrode interconnect 161 and the second common electrode interconnect 162. Further, the thickness of the second common electrode interconnect 162 is formed thicker than that of the first common electrode interconnect 161. The support substrate 5 is provided with the first concave potion to accommodate the second common electrode interconnect 162 so that the support substrate 5 is not bonded to the channel substrate 2 through the second common electrode interconnect 162 although a part of the support substrate 5 may bonded to the channel substrate 2 through a part of the first common electrode interconnect 161. With this structure, the resistance of the common electrode interconnect 16 can be lowered and the vibration layer 1 above the ink channels 7 can be enforced. Therefore, voltage drop, adjacent cross-talk, and ink chamber mechanical compliance can be prevented. Therefore, the inkjet head 100 of a smaller size having uniform discharging characteristics can be obtained.

Further, Au plating layers necessary for wire bonding may be also formed when forming the second common electrode interconnects 162 to reduce the manufacturing process.

According to the embodiment, the following problems which cannot be solved by the related arts can be solved.

According to Patent Document 1 described above, it is not assumed to enforce the rigidity of the vibration layer.

According to Patent Document 2, the rigidity may be improved by enforcing the above part of the ink channels by the piezoelectric layers. However, it is difficult to form the common electrode interconnect above the ink channels, for reducing its resistance, as the piezoelectric layers are formed above the ink channels. Further, as the piezoelectric layers, functioning as the enforcing layers, are separately formed for corresponding individual ink chambers, it is difficult to remove the mutual interference between the adjacent ink chambers. According to Patent Document 3, as the height of the ink channel is formed to be lower than that of the individual ink chamber, it is difficult to improve the uniformity of the flow resistance of the ink channels.

According to Patent Document 4, as the thickness of the electrode is about fpm and is not thick enough. Therefore, it is difficult to lower the resistance of the common electrode.

The present invention is not limited to the specifically disclosed embodiments, and variations and modifications may be made without departing from the scope of the present invention.

The present application is based on Japanese Priority Application No. 2011-27673 filed on Feb. 10, 2011, the entire contents of which are hereby incorporated herein by reference.

What is claimed is:

1. An inkjet head comprising:

a nozzle plate which is provided with plural nozzles aligned in a first direction, a channel substrate which is provided with plural individual ink chambers aligned in the first direction and corresponding to the plural nozzles and plural ink channels aligned in the first direction and corresponding to the plural nozzles such that each of the ink channels communicates with the corresponding nozzle through the corresponding individual ink chamber, the nozzle plate being bonded to one surface of the channel substrate;

a multi-interconnect structure which is formed on the other surface of the channel substrate, including a vibration layer formed on the other surface of the channel substrate, plural piezoelectric elements formed on the vibration layer at areas corresponding to the plural individual ink chambers to be aligned in the first direction, each of the piezoelectric elements including a first electrode, a piezoelectric layer and a second electrode stacked in this order, the first electrode being a common electrode commonly provided for the plural piezoelectric elements and is extended to areas corresponding to the plural ink channels, and a common electrode interconnect electrically connected to the first electrode and formed at areas corresponding to the plural ink channels to be extending in the first direction, the common electrode interconnect including a first common electrode interconnect and a second common electrode interconnect which has a thickness thicker than that of the first common electrode interconnect; and a support substrate which is bonded to the channel substrate through the multi-interconnect structure, the support substrate being provided with a first concave portion at a surface facing the channel substrate at an area corresponding to the second common electrode interconnect to accommodate the second common electrode interconnect.

2. The inkjet head according to claim 1, wherein the support substrate is further provided with plural second concave portions at the surface facing the channel substrate at areas respectively corresponding to the plural piezoelectric elements, the support substrate contacts the multi-interconnect structure at areas between the adjacent second concave portions to separate the plural second concave portions from each other.

3. The inkjet head according to claim 1, wherein the multi-interconnect structure further includes an insulating interlayer formed on the first common electrode interconnect, the second common electrode interconnect is formed on a part of the insulating interlayer and is electrically connected to the first common electrode interconnect through contacts formed in the insulating interlayer, and the support substrate is bonded to the channel substrate through the insulating interlayer.

4. The inkjet head according to claim 1, wherein the second common electrode interconnect is composed of a stacked structure of a Ni layer and an Au layer.

5. The inkjet head according to claim 1, wherein the support substrate is bonded to the channel substrate through a part of the first common electrode interconnect.

6. The inkjet head according to claim 1, wherein the length of the depth of the first concave portion of the support substrate is greater than the thickness of the second common electrode interconnect.

7. The inkjet head according to claim 1, wherein the ink channels and the individual ink chambers are formed to have the same height.

8. The inkjet head according to claim 1, wherein the multi-interconnect structure further includes plural individual electrode interconnects electrically connected respectively to the second electrodes of the plural piezoelectric elements, plural individual electrode pads respectively formed on and electrically connected to the individual electrode interconnects, and a common electrode pad electrically connected to the common electrode interconnect where the plural individual electrode pads and the common electrode pad are provided at the opposite side of the plural ink channels to be aligned in the first direction, the first common electrode interconnect includes a portion extending in a second direction crossing the first direction to extend to the common electrode pad, and the common electrode pad is formed on the portion of the first common electrode interconnect.

9. The inkjet head according to claim 8, wherein the individual electrode pads, the common electrode pad, and the second common electrode interconnect are formed by the same material.

10. The inkjet head according to claim 8, wherein the second direction is perpendicular to the first direction.

11. The inkjet head according to claim 8, wherein the first common electrode interconnect includes a portion extending in the first direction and the second common electrode interconnect is formed on the portion of the first common electrode interconnect extending in the second direction.

12. The inkjet head according to claim 8, wherein the second common electrode interconnect is not formed on the portion of the first common electrode interconnect extending in the second direction and the support substrate contacts the multi-interconnect structure at an area corresponding to the portion of the first common electrode interconnect extending in the second direction.

13. The inkjet head according to claim 12, wherein the portion of the first common electrode interconnect extending in the second direction is formed at the edge on the channel substrate.

* * * * *